US005979807A

United States Patent [19]

Pellicer

[11] Patent Number: 5,979,807

[45] Date of Patent: Nov. 9, 1999

[54] PROCESS AND PLANT FOR THE PRODUCTION OF A FLUID FINE PASTE HARDENABLE AFTER MOLDING

[76] Inventor: Carlos Fradera Pellicer, Av. Tarragpma. Urb. Terabella, Edificio E, Escalera X, 1o 1a, Andorra La Vella, Spain

[21] Appl. No.: 09/043,692

[22] PCT Filed: Jul. 28, 1997

[86] PCT No.: PCT/ES97/00194

§ 371 Date: Mar. 26, 1998

§ 102(e) Date: Mar. 26, 1998

[87] PCT Pub. No.: WO98/05483

PCT Pub. Date: Feb. 12, 1998

[30] Foreign Application Priority Data

Aug. 1, 1996 [SE] Sweden ..... 9601719

[51] Int. Cl.[6] ..... B02C 19/12

[52] U.S. Cl. ..... 241/46.11; 241/101.8; 366/302; 366/341

[58] Field of Search ..... 241/101.8, 46.11, 241/172; 366/14, 15, 91, 295, 302

[56] References Cited

U.S. PATENT DOCUMENTS

| | | | |
|---|---|---|---|
| 1,577,052 | 3/1926 | Auspitzer | 241/101.8 |
| 2,492,421 | 12/1949 | Golben | 241/101.8 |
| 2,669,924 | 2/1954 | Wiemer | 241/101.8 |
| 3,927,868 | 12/1975 | Moore | 366/341 |
| 4,264,212 | 4/1981 | Tookey . | |
| 4,403,868 | 9/1983 | Kupka . | |
| 4,883,362 | 11/1989 | Gartner et al. | 366/341 |
| 5,028,010 | 7/1991 | Sansing | 241/101.8 |
| 5,277,494 | 1/1994 | Lehrke et al. . | |
| 5,451,376 | 9/1995 | Proksa et al. | 241/101.8 |

FOREIGN PATENT DOCUMENTS

| | | |
|---|---|---|
| 0 659 471 | 6/1995 | European Pat. Off. . |
| 544222 | 7/1986 | Spain . |
| 2009650 | 10/1989 | Spain . |
| 2013158 | 4/1990 | Spain . |

*Primary Examiner*—Mark Rosenbaum
*Attorney, Agent, or Firm*—Alston&Bird LLP

[57] ABSTRACT

The process is implemented in a plant which comprises a homogenising apparatus (1) consisting of a first vertical container (10) having axial stirring devices (11) and peripheral stirring devices (12) with independently actuated blades (15), and grinding apparatus (3) comprised of an external static cylindrical body (21) with centripetally projecting stubs (24) and wherein is housed an internal rotary cylindrical body (25) provided with centrifugally projecting stubs (24); a continuous mixter (4) of which the internal surface (28) has crossing furrows (29) and wherein is housed a cylindrical body (34) of which the external surface (30) has second furrows which also cross each other, so that all the furrows form conduits which initiate in an extreme chamber (31) and which terminate in an extreme chamber (32) for the outflow of fluids resulting from produced mixtures; and a nozzle (5) for supplying the fine fluid paste, said nozzle being comprised of a main tubular body (33) having on the one hand an extreme annular enclosure (36) provided with second inlet nozzles (37) for additives and pressure gas fluid and, on the other hand, outlet conduits which open into ports (38) of the main tubular body (33).

6 Claims, 5 Drawing Sheets

PROCESS AND PLANT FOR THE PRODUCTION OF A FLUID FINE PASTE HARDENABLE AFTER MOLDING

The invention relates to a process for the production of a fluid fine paste hardenable after molding, and more particularly fluid pastes prepared from materials such as cement, clays, kaolin and the like in admixture with water and other additives to form solid bodies once hardened by setting, heating or polymerization, particularly fluid pastes composed of solid materials, such as cement, clays, kaolin and the like in admixture with water and other compatible complementary products, such as aggregates, dyestuffs, fillers, fiber reinforcements, polymers, etc., and functional additives such as inhibitors, accelerators, thixotropic agents, fluidisers, foaming agents, etc., to form solid bodies, after molding and hardening by setting, heating and/or polymerization, applicable in the building industry. The listing of such materials in which the preferred ones of the said industry are cited, is given only as a guidance and is in no way restrictive, it being of application to other industries, such as the chemical, food, naval, paint manufacturing and others.

The invention also relates to a plant for the production of a fluid fine paste hardenable after molding.

The solid bodies, obtained with the materials listed as preferred, are prefabricated elements for the building industry, such as frontage panels, internal closure partitions, tiles and floor tiles, pieces imitating natural stones (marble, granite, etc.), indoor and outdoor chimneys, urban furnishing, imitation wood pieces, swimming pools, cisterns, irrigation canals and many more.

For making such solid bodies, the present applicant filed Spanish patent application 9502438 relative to a process and a plant for carrying out the process, in which the starting material was an air hardenable fluid material.

The working of the subject matter of the above application has enabled the constitution of the said fluid material to be improved, converting it into a fluid fine paste allowing the details of the molds to be reproduced more faithfully, the process for the preparation of the said fluid fine paste and one possible plant for the preparation thereof the subject matter of the present invention.

On the other hand, several ways are known of preparing homogenous mixtures of materials, such as those disclosed in the following Spanish patents 544,222 (Madera) which consists of a mixing plant for producing mortars, renderings and the like, in which a vertical mixing machine receives the products to be mixed and homogenizes them; 2,009,650 (Rosell) consisting of a mortar mixing machine for the building industry, in which the mixer is horizontal and has a turbine shaft for mixing the dry mortar with the water; and 2,013,158 (Fabregat), consisting of a mixing apparatus for mortars, paints and paste-like materials, formed by an open container having a tumbling tool formed by a shaft coupled to a powered machine It is an object of the invention to provide a process and a plant for preparing the said fluid fine paste in a perfectly homogenized condition and having a composition appropriate for each application, since they allow for the combination of a large numbers of parameters, whether they be mechanical operations or addition components.

The process is characterized in that the basic solid and liquid products for forming the fluid paste are mixed in a homogenizing apparatus, in which the said basic products are dispersed and kneaded, together with addition components, to obtain a first fluid homogenous mixture, which is thereafter fed to a grinding apparatus, in which the coarse particles and lumps present in the said first fluid homogenous mixture are ground and to which there may be added coloring agents, as the case may be, to give a second homogenous fluid fine mixture which is thereafter transferred to a continuous mixer, where additives and/or coloring matter are added, forming a fluid fine paste which is continuously fed to a delivery nozzle for said fluid fine paste to which more additives are added and, optionally, reinforcing fibers and/or a gaseous foaming fluid.

In turn, the plant is characterized in that it comprises a homogenizing apparatus, a grinding apparatus, a continuous mixer and a delivery nozzle for a fluid fine paste. The homogenizing apparatus is formed by a first vertical vessel, having internal stirring means for the mixture to be homogenized; said means comprising: [a] axial means formed by a rotary vertical and axially moveable shaft which, at the lower end portion thereof, is provided with at least one generally discoid stirring element and, at the end portion thereof external to said first vertical vessel, with a drive means; and [b] peripheral means formed by at least one blade which moves around an internal peripheral region of the first vertical vessel and is provided with a ploughshare-like widening at the upper end thereof, slopingly disposed relative to the plane of rotation and in the direction of the movement thereof; said peripheral means being driven by a rotary drive means causing it to rotate in the opposite direction to the direction of rotation of said axial means.

The grinding apparatus is formed by a static external cylindrical body: [a] which is provided with a cover plate at one end, said plate having first inlet ports; and a discharge port at the other end thereof; [b] which is provided with a plurality of cylindrical stubs which: [i] extend radially inwardly from the inner surface thereof; [ii] are arranged in groups and the different groups are disposed in equidistant parallel planes; and [iii] each stub of one of said groups is axially aligned with stubs of the remaining groups; [c] which comprises internally thereof a rotary internal cylindrical body, which: [i] has a smaller diameter that the distance between opposite stubs; [ii] has a plurality of ovalised stubs extending radially outwardly from the outer surface of said rotary internal cylindrical body and which are arranged in equidistant parallel planes, inserted between the planes defined by said cylindrical stubs; and [iii] each of said ovalised stubs defines a sloping plane of symmetry.

The continuous mixer: [a] defines a first internal cylindrical surface, slotted by first crossing furrows forming first crossover points and first squares defining a first grid square; and [b] snugly houses a cylindrical body defining a second external cylindrical surface: [a] 5directly and snugly engaging said first internal cylindrical surface; [ii] slotted by second also crossing furrows forming second crossover points and second squares defining a second grid square; and said first crossover points of said first furrows of said first internal cylindrical surface are centered over said second squares of said second external cylindrical surface, while said second crossover points of said second furrows of said second external surface are centered on said first squares of said first internal surface, so that all the furrows form passages which start at an end inlet chamber for the fluids to be mixed and terminate in an end discharge chamber for the fluids resulting from the mixing caused by the passage of said fluids through said furrows.

To facilitate an understanding of the foregoing ideas, there is described hereinafter the process and one embodiment of the plant for carrying out the process and of constituent elements thereof, with reference to the accompanying illustrative drawings, in which.

Figure 1:
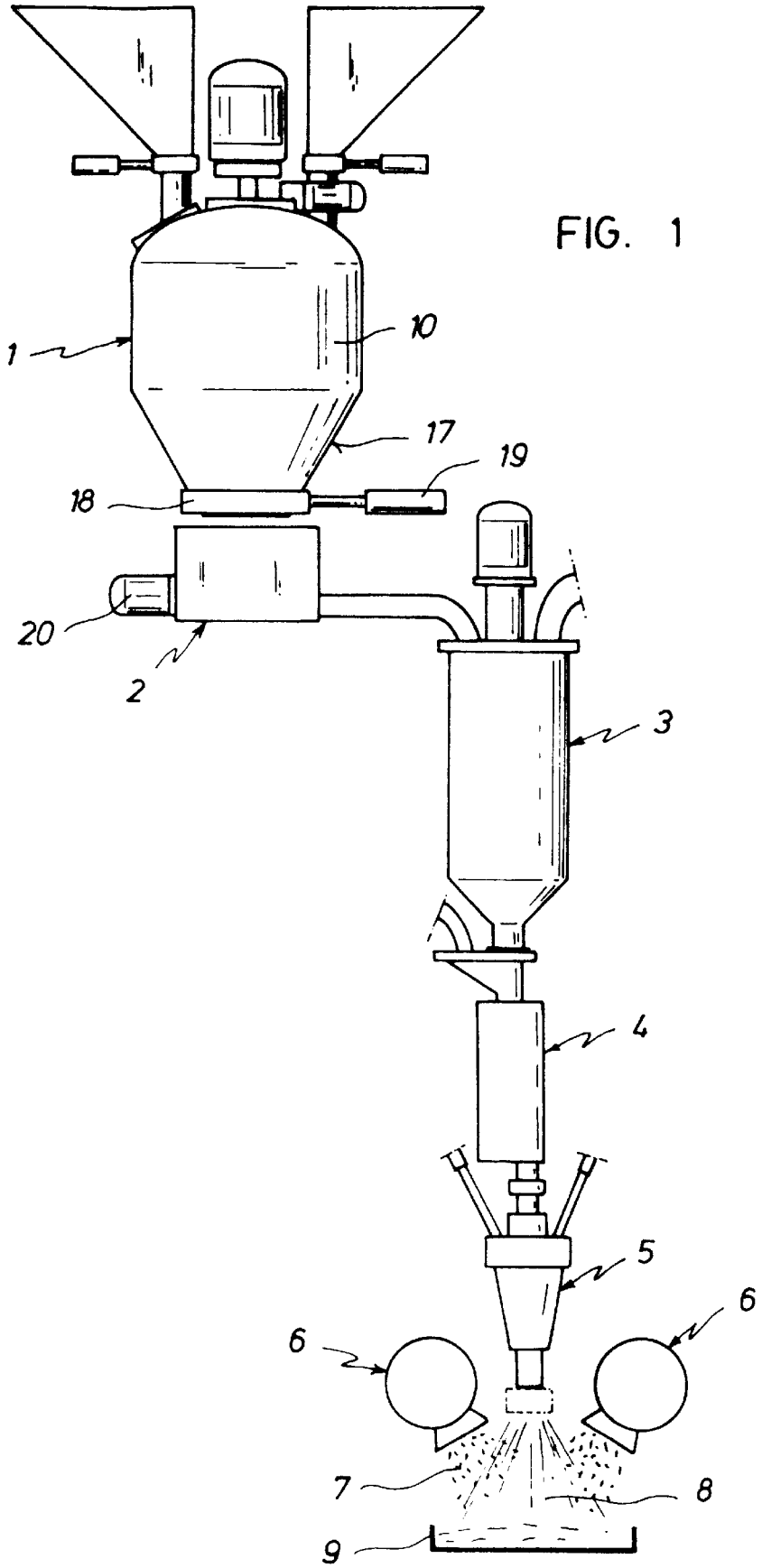
FIG. 1 is a schematic elevation view of a plant according to the invention, for carrying out the said process.
Figure 2:
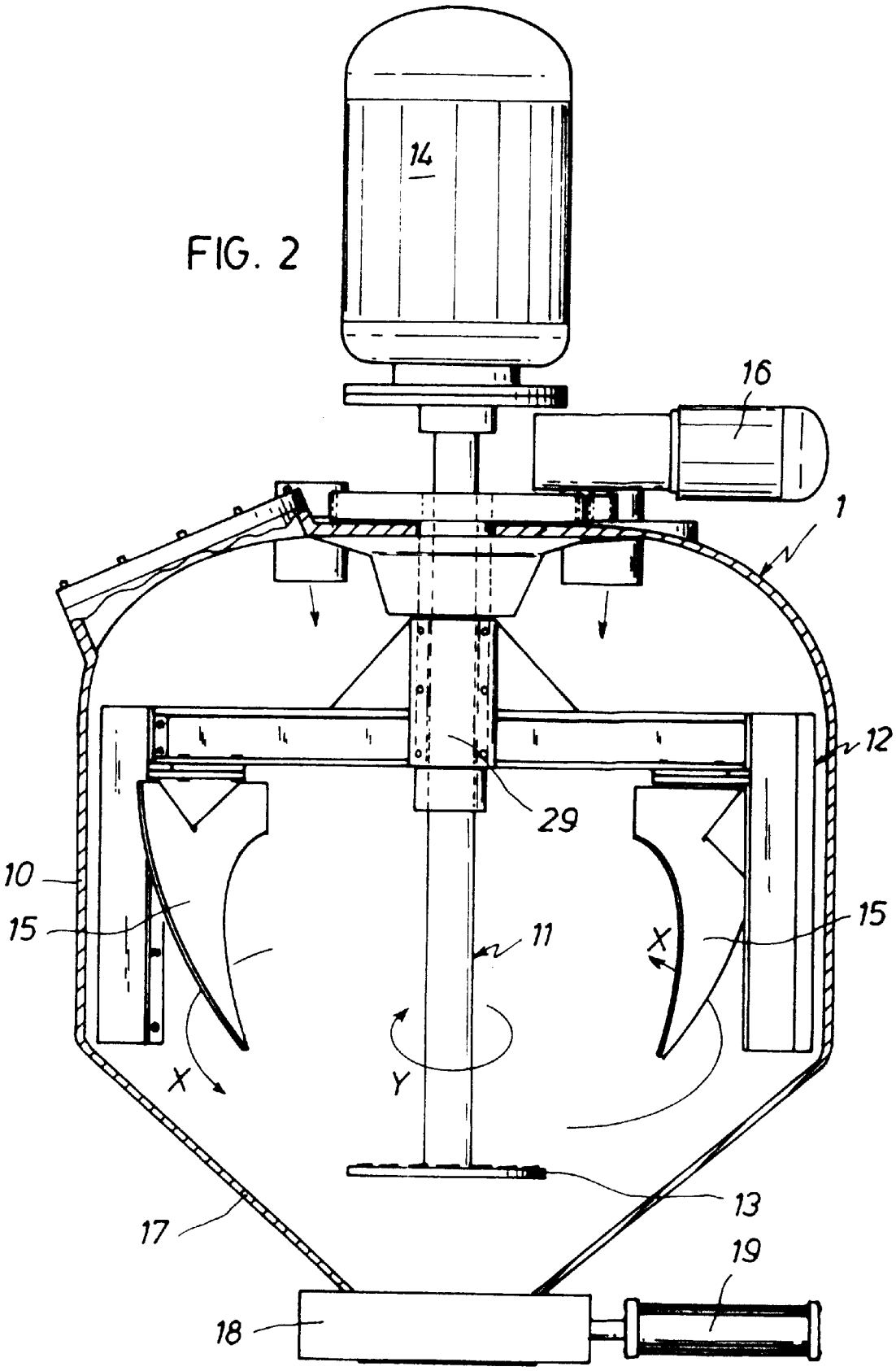
FIG. 2 is a schematic elevation view, partly in axial section, of the homogenizing apparatus for the basic mix.
Figure 3:
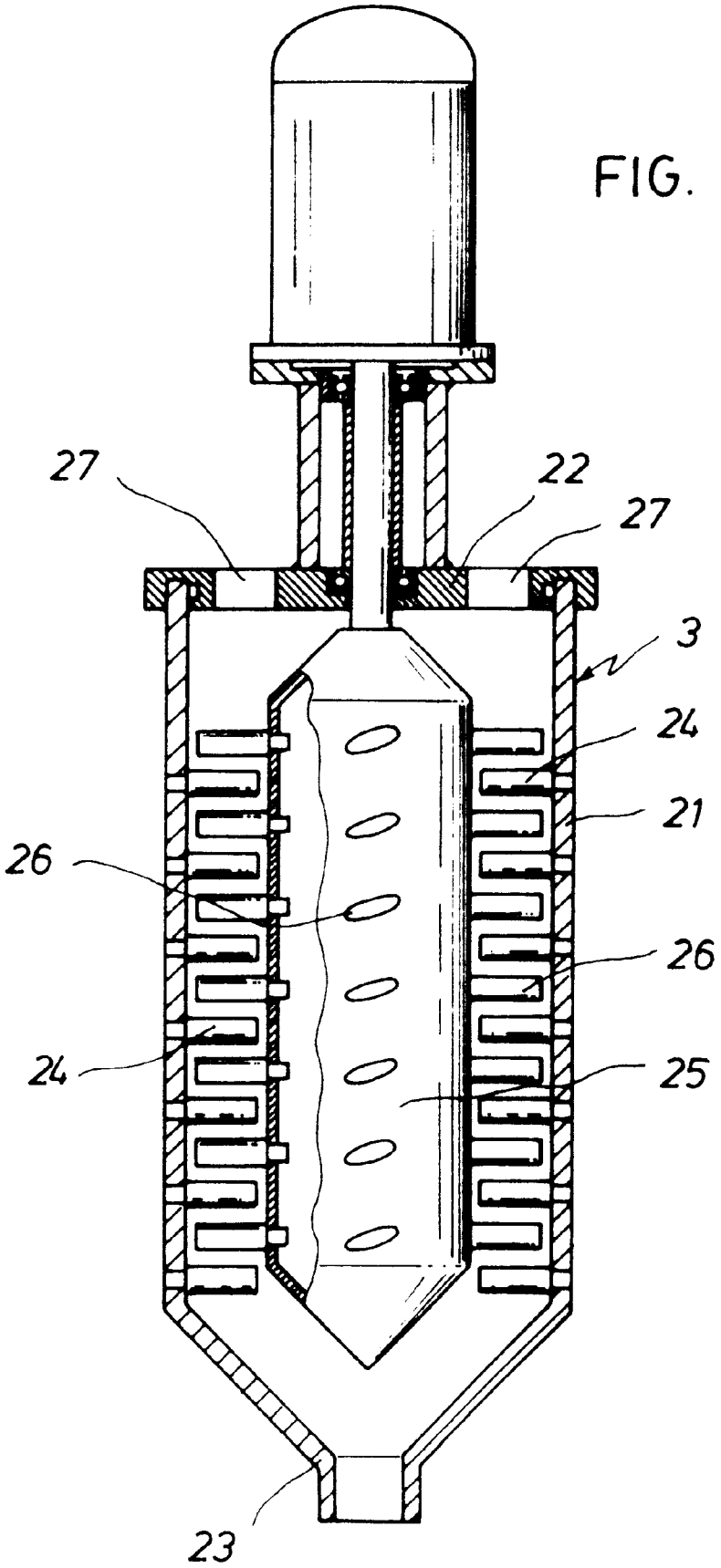
FIG. 3 is a schematic axial cross section view of the grinding apparatus for the basic homogenous fluid mix from the homogenizing apparatus.
Figure 4:
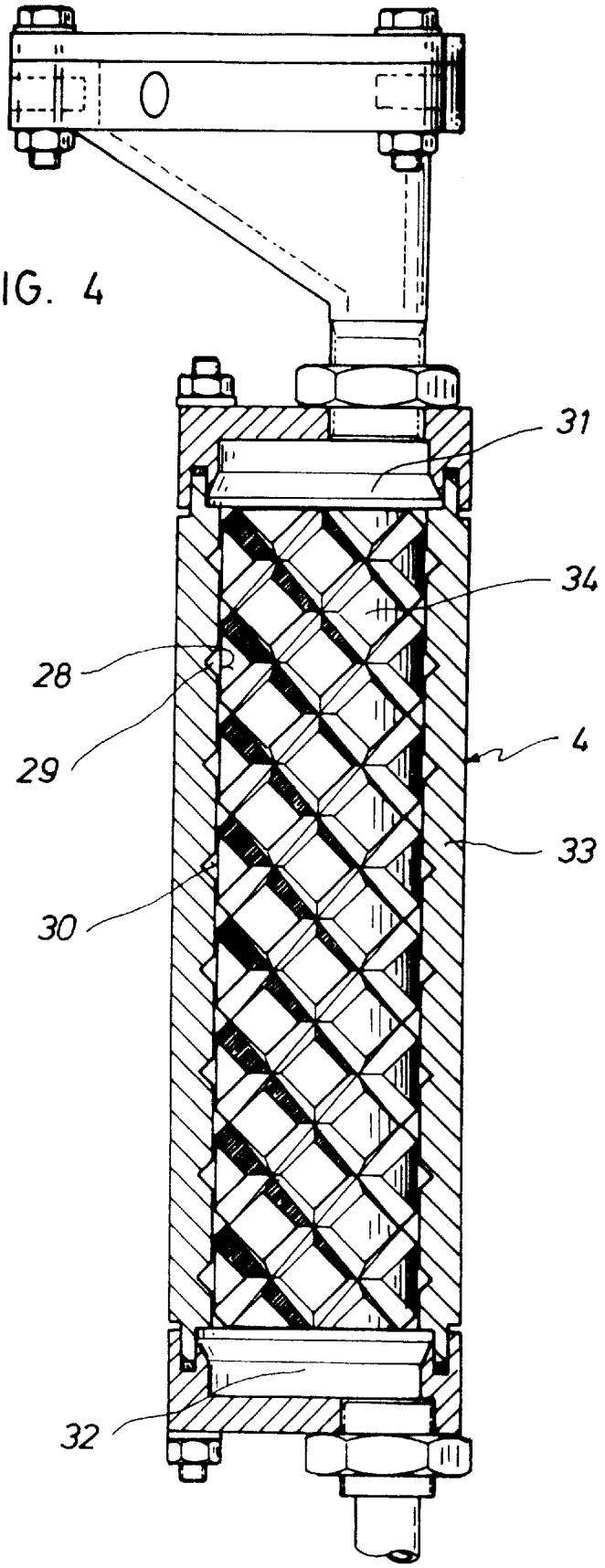
FIG. 4 is a schematic axial cross section view of the continuous mixer for the fine homogenous fluid mixture from the grinding apparatus.
Figure 5:
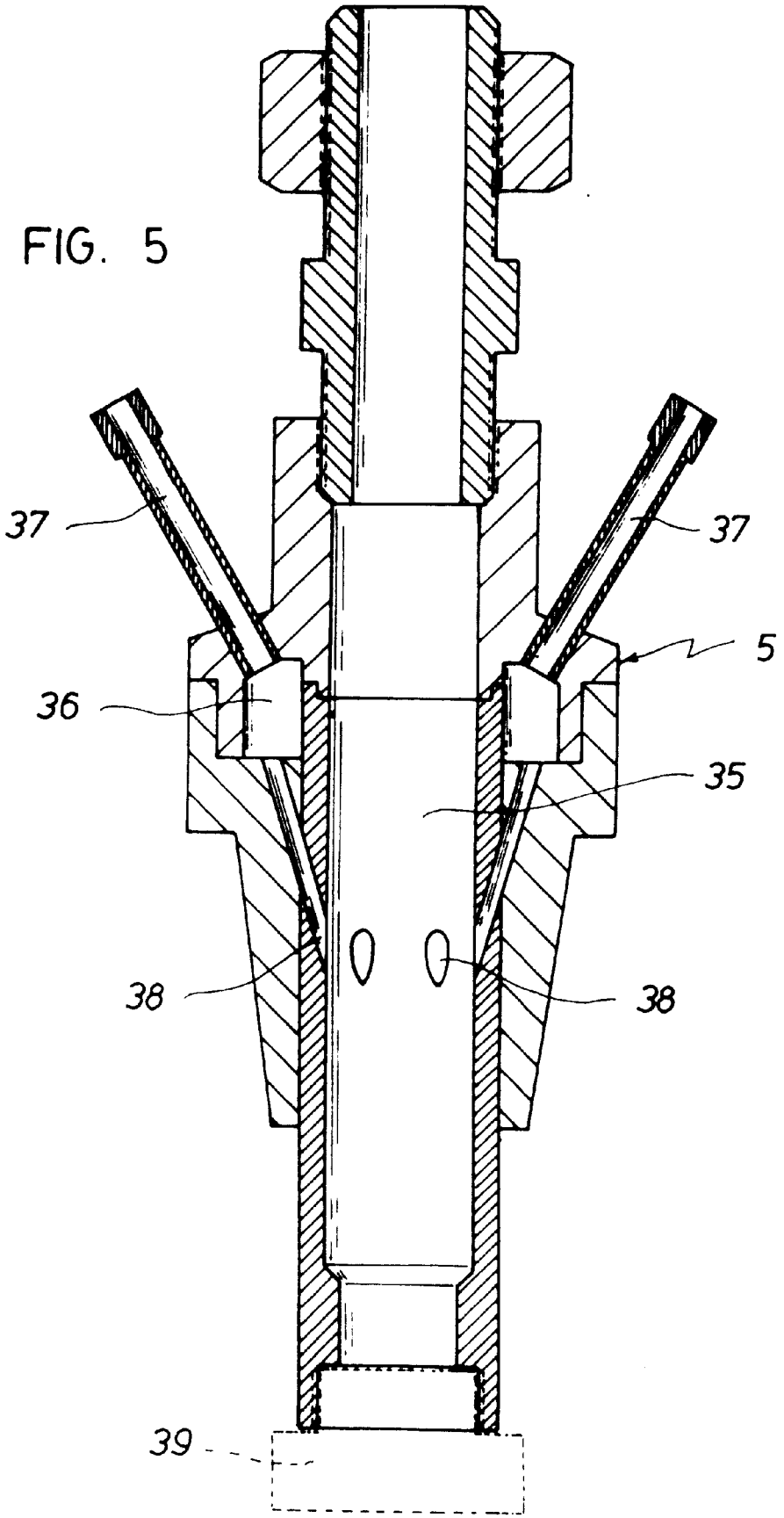
FIG. 5 is a schematic axial cross section view of the nozzle delivering the fluid fine paste under suitable conditions for molding.

The essential components of the instant plant, consisting of a homogenizing apparatus 1, a collecting pan 2, a grinding apparatus 3, a continuous mixer 4, a delivery nozzle 5 and two spray stations 6 for the reinforcement fibers 7 on the spray cone 8 of the fluid fine paste to be cast in a mold 9 are shown in consecutive order in FIG. 1.

The homogenizing apparatus 1 is formed by a first vertical vessel 10 having internal stirring means for the mix to be homogenized. The internal means are differentiated between axial means 11 and peripheral means 12, the former being constituted by a rotary vertical and axially moveable shaft which, at the lower end portion thereof, is provided with at least one generally discoid stirring member 13 and, at the end portion external to said first vertical vessel 10, with a motor device 14. In turn, the peripheral means 12 is formed by one or more blades 15 which, moving around the internal peripheral region of the first vertical vessel 10, are provided with a ploughshare-like widening at the upper end thereof, slopingly disposed relative to the plane of rotation thereof, and they are driven by a rotary device causing them to rotate in the direction X contrary to the direction Y of rotation of the axial means 11. The lower portion of the first vertical vessel 10 is shaped like a hopper 17 and is closed by a gate valve 18 which, driven by a drive means 19, discharges a homogenized mass or first fluid homogenous mix into the collecting pan 2, which is provided with a motor pump 20 driving the mass towards the grinding apparatus 3 up to the delivery nozzle 5.

The grinding apparatus 3 is formed by a static external cylindrical body 21 provided, at one end thereof, with a cover plate 22 and, at the other end thereof, with a discharge port 23. Within the body 21 there is a plurality of cylindrical stubs 24, extending radially inwardly from the inner surface of the static external cylindrical body 21. These stubs 24 are arranged in groups and the different groups are disposed in equidistant parallel planes; and furthermore each stub of one of said groups is axially aligned with stubs of the remaining groups. Within the body 21 there is housed a rotary internal cylindrical body 25, having a smaller diameter that the diameter defined between opposite cylindrical stubs 24 and having a plurality of ovalised stubs 26 extending radially outwardly from the outer surface thereof, said stubs being arranged in equidistant parallel planes, inserted between the planes of said cylindrical stubs 24; and having their individual plane of symmetry sloping in a direction contrary to that of rotation of the body. The cover plate 22 is provided with first inlet ports 27 for the first homogenous fluid mix, additives and coloring agents and water for pressurized cleaning. A second fluid homogenous mix exits from the grinding apparatus 3.

The continuous mixer 4 comprises a tubular body 33 having a first internal cylindrical surface 28, slofted by first crossing furrows 29 forming first crossover points and first squares defining a first grid square. Within the tubular body 33 there is snugly housed a cylindrical body 34, which may be tubular or not. The body 34 has a second external cylindrical surface 30 slotted (by means of second furrows forming further crossover points and further squares, the configuration of which is also as a grid square) in a similar fashion to the first internal surface 28 and directly and snugly engaging said first internal surface 28. The crossover points of the furrows 29 of the first internal surface 28 are located over the center of the squares of the second external surface 30 and vice versa, such that all the furrows, which are continuous, form passages which start at an end inlet chamber 31 for the fluids to be mixed and terminate in an end discharge chamber 32. The fluid fine paste resulting from the mixing caused by the passage of the materials through these furrows exits from the chamber 32.

The delivery nozzle 5 for the fluid fine paste is formed by a main tubular body 35 comprising an annular end enclosure 36 which is provided, on the one hand, with second inlet nozzles 37 for additives and a pressurized gaseous fluid and, on the other hand, with outlet conduits terminating in ports 38 in the main tubular body 35 downstream of the annular end enclosure 36.

The discharge port of the delivery nozzle 5 is provided with means 39 for forming the outlet jet of the fluid fine paste. The delivery nozzle 5 is associated, furthermore, with the two spraying stations 6 for the reinforcement fibers 7 for incorporating these reinforcement fibers 7 in the spray cone 8 of the fine paste.

I claim:

1. A plant for preparing a fluid fine paste hardenable after molding, comprising a homogenizing apparatus (1); a grinding apparatus (3); a continuous mixer (4) which defines a first internal surface; and a delivery nozzle (5) for a fluid fine paste, characterized in that:

said first internal surface of said continuous mixer is slotted by first crossing furrows (29) forming first crossover points and first squares defining a first grid square;

said continuous mixer (4) snugly houses a cylindrical body (34) defining a second external cylindrical surface (30): [i] directly and snugly engaging said first internal cylindrical surface (28); [ii] slotted by a second also crossing furrows forming second crossover points and second squares defining a second grid square; and in that said first crossover points of said first furrows (29) of said first internal cylindrical surface (28) are centered over said second squares of said external cylindrical surface (30), while said second crossover points of said second furrows (29) of said second external surface (30) are centered on said first squares of said first internal surface (28), so that the furrows form passages which start in an end inlet chamber (31) for the fluids to be mixed and terminate in an end discharge chamber (32) for the fluids resulting from the mixing caused by the passage of said fluids through said furrows.

2. The plant of claim 1, characterized in that said homogenizing apparatus (1) is formed by a first vertical vessel (10), having internal stirring means for the mixture to be homogenized; said means comprising: [a] axial means (11) formed by a rotary vertical and axially moveable shaft which, at the lower end portion thereof, is provided with at least one generally discoid stirring element (13) and, at the end portion thereof external to said first vertical vessel (10), with a motor device (14); and [b] peripheral means (12) formed by at least one blade (15) which moves around an internal peripheral region of the first vertical vessel (10) and is provided with a ploughshare-like widening at the upper end thereof, slopingly disposed relative to the plane of rotation thereof and in the direction of the movement thereof; said peripheral means (12) being driven by a rotary means (16) causing it to rotate in the opposite direction to the direction of rotation of said axial means (11).

3. The plant of claim 1, characterized in that said grinding apparatus (3) is formed by a static external cylindrical body (21):

[a] which is provided with a cover plate (22) at one end, said plate having first inlet ports (27); and a discharge port (23) at the other end thereof;

[b] which is provided with a plurality of cylindrical stubs (24) which: [ii] extend radially inwardly from the inner surface thereof; [i] are arranged in groups and the different groups are disposed in equidistant parallel planes; and [iii] each stub (24) of one of said groups is axially aligned with stubs (24) of the remaining groups;

[c] which comprises internally thereof a rotary internal cylindrical body (25), which: [i] has a smaller diameter that the distance between opposite stubs (24); [ii] has a plurality of ovalised stubs (26) extending radially outwardly from the outer surface of said rotary internal cylindrical body (25) and which are arranged in equidistant parallel planes, inserted between the planes defined by said cylindrical stubs (24); and [iii] each of said ovalised stubs (26) defines a sloping plane of symmetry.

4. The plant of claim 1, characterized in that said delivery nozzle (5) for the fluid fine paste is formed by a main tubular body (35) comprising an annular end enclosure (36) which is provided, on the one hand, with second inlet nozzles (37) for additives and a pressurized gaseous fluid and, on the other hand, with outlet conduits terminating in ports (38) in the main tubular body (35) downstream of the annular end enclosure (36).

5. The plant of claim 4, characterized in that said delivery nozzle (5) is provided with a discharge port having means (39) for forming the outlet jet of the fluid fine paste.

6. The plant of claim 4, characterized in that said delivery nozzle (5) is associated with means for incorporating reinforcement fibers in the fine paste.

* * * * *

UNITED STATES PATENT AND TRADEMARK OFFICE
CERTIFICATE OF CORRECTION

PATENT NO. : 5,979,807

DATED : November 9, 1999

INVENTOR(S) : Pellicer

It is certified that error appears in the above-identified patent and that said Letters Patent is hereby corrected as shown below:

Title page, [76] Inventor's address, "Tarragpma, Urb. Terabella" should read --Tarragona, Urb. Terrabella--.

Title page, [30] Foreign Application Priority Data, "[SE] Sweden" should read --[ES] Spain--.

Title page, [56] References Cited, insert the following:

--OTHER PUBLICATIONS

Japanese Abstracts - "Method For Laminating Green Sheet", "Manufacture Of Metal Tube Encased Concrete Column", "Mortar Mixer", Vol. 16, Number 30, dated January 24, 1992--.

Column 5, line 14, "[ii]" should read --[i]--; line 15, "[i]" should read --[ii]--.

Signed and Sealed this

Eighteenth Day of July, 2000

*Attest:*

Q. TODD DICKINSON

*Attesting Officer*

*Director of Patents and Trademarks*